US012228355B2

(12) United States Patent
Kappes

(10) Patent No.: US 12,228,355 B2
(45) Date of Patent: Feb. 18, 2025

(54) MODULAR TUBE-TO-TUBE SOLID-MATRIX HEAT EXCHANGER

(71) Applicant: Kappes Cassiday & Associates, Reno, NV (US)

(72) Inventor: Daniel W. Kappes, Reno, NV (US)

(73) Assignee: Kappes, Cassiday & Associates, Reno, NV (US)

( * ) Notice: Subject to any disclaimer, the term of this patent is extended or adjusted under 35 U.S.C. 154(b) by 0 days.

(21) Appl. No.: 17/665,442

(22) Filed: Feb. 4, 2022

(65) Prior Publication Data

US 2024/0240883 A1 Jul. 18, 2024

(51) Int. Cl.
*F28F 9/26* (2006.01)
*F28D 7/16* (2006.01)

(52) U.S. Cl.
CPC . *F28F 9/26* (2013.01); *F28D 7/16* (2013.01)

(58) Field of Classification Search
CPC ..... F28F 9/26; F28D 7/16
See application file for complete search history.

(56) References Cited

U.S. PATENT DOCUMENTS 1,571,068 A * 1/1926 Stancliffe ..... F28F 9/26 165/165
1,799,626 A * 4/1931 Keith, Jr. ..... F28F 7/02 165/172
2,401,797 A * 6/1946 Rasmussen ..... F28F 13/003 210/185
3,272,260 A * 9/1966 Samuel ..... F28F 7/02 165/DIG. 396
3,444,924 A * 5/1969 Lustenader ..... F28F 9/0219 165/DIG. 402
3,595,310 A 7/1971 Burne et al.
3,693,711 A * 9/1972 Zygiel ..... B21C 37/151 165/DIG. 397
3,849,854 A * 11/1974 Mattioli ..... F28F 21/084 228/183
3,907,026 A * 9/1975 Mangus ..... F22B 1/063 165/142
3,999,602 A 12/1976 Fewell et al.
4,156,625 A 5/1979 Wachendorfer
(Continued)

FOREIGN PATENT DOCUMENTS

CA 2761604 C 6/2011
DE 1105894 B 5/1961
(Continued)

*Primary Examiner* — Bayan Salone
(74) *Attorney, Agent, or Firm* — Kenneth D'Alessandro

(57) ABSTRACT

A solid matrix tube heat exchanger includes an assembly of solid matrix modules each formed from a thermally conductive material and having opposed first and second planar faces, each solid matrix module including a plurality of spaced-apart tubes arranged in an identical pattern and extending between the first and second faces in an axial direction, the solid matrix modules positioned such that corresponding ones of the tubes in all of the solid matrix modules are axially aligned with each other. The corresponding ones of the tubes in adjacent ones of the solid matrix modules coupled to one another by nipples extending past the end of each tube, the nipples mechanically bonded to inner walls of the corresponding ones of the tubes.

3 Claims, 7 Drawing Sheets

(56) References Cited

U.S. PATENT DOCUMENTS 4,252,752 A * 2/1981 Flandroy ..... F28D 5/02 261/153
4,328,860 A * 5/1982 Hoffmuller ..... F28F 9/013 165/83
4,527,819 A * 7/1985 Desilets ..... B23K 1/0012 228/258
4,711,298 A * 12/1987 Rogier ..... F28F 21/04 165/DIG. 395
4,782,892 A * 11/1988 Ostbo ..... F28F 7/02 165/DIG. 397
5,139,650 A 8/1992 Lenglet
5,242,015 A 9/1993 Saperstein et al.
5,285,845 A * 2/1994 Ostbo ..... F28F 7/02 165/164
5,980,838 A * 11/1999 von Hippel ..... B01J 19/2485 422/654
6,355,145 B1 3/2002 Kresnyak et al.
6,626,235 B1 * 9/2003 Christie ..... F28F 1/02 165/158
6,896,043 B2 * 5/2005 Dunn ..... F28D 9/0062 165/165
7,285,153 B2 * 10/2007 Bruun ..... F23C 13/00 165/DIG. 395
8,051,902 B2 11/2011 Kappes et al.
8,607,850 B2 * 12/2013 Kappes ..... F28F 7/02 210/741
10,288,363 B2 * 5/2019 Matsui ..... F25B 39/022
11,035,616 B2 * 6/2021 Rhoden ..... F02C 7/224
11,209,218 B2 * 12/2021 Chan ..... F28F 13/12
11,300,368 B2 * 4/2022 Kupiszewski ..... F28F 21/08
11,448,467 B1 * 9/2022 Hayes ..... B21D 53/06
11,662,150 B2 * 5/2023 Martinez ..... F02C 7/224 165/164
11,713,929 B2 * 8/2023 Rhoden ..... F02C 7/224 165/165
11,879,691 B2 * 1/2024 Gerstler ..... F28D 21/0003
2005/0028964 A1 * 2/2005 Cleland ..... F28D 7/08 165/47
2010/0044023 A1 * 2/2010 Canales ..... F28F 9/26 29/890.047
2011/0080035 A1 4/2011 Bishop

FOREIGN PATENT DOCUMENTS

DE 2541424 A1 3/1977
FR 2889582 2/2007

* cited by examiner

MODULAR TUBE-TO-TUBE SOLID-MATRIX HEAT EXCHANGER

BACKGROUND OF THE INVENTION

Field of the Invention

The present invention relates to heat exchangers and in particular to the transfer of heat from one liquid, such as a slurry, to another.

Description of Related Art

A heat exchanger is a device used to transfer heat from one medium to another. In industries such as the mining industry there are many processes that require heating a slurry such as a mineral-ore slurry. A slurry is a suspension of solid particles in a fluid. Slurries contain solid particles that have a tendency to settle. Some slurries also have a tendency to create scale. Both of these issues complicate heat-exchange processes, due to the need to periodically clean heat-transfer and other apparatus used in slurry processing. In addition, some slurries are abrasive and over time will erode the walls of the tubes in which they are flowing.

The high cost of energy makes heat exchangers crucial to the economic feasibility of certain industrial processes. As a result, when it is necessary to heat a mineral-ore slurry in a countercurrent manner (by cooling another slurry passing in the opposite direction), very complex systems have been used, such as contact heat exchangers in which steam is evolved from one slurry and absorbed into the other slurry in an adjacent compartment. This is the typical type of exchanger used in Bayer Process plants for producing alumina from Bauxite ore. Alternatively, steam evolved from the hotter slurry in one chamber may be used on the shell side of a shell-and-tube exchanger to heat cooler slurry. This is the typical type of exchanger used where slurry dilution is not desirable, such as in gold autoclave systems.

Slurries have been run through existing heat exchanger configurations such as spiral or plate heat exchangers. A spiral exchanger includes a pair of flat surfaces that are coiled to form two channels in a counter current arrangement with each channel having a long curved path. A plate exchanger is composed of multiple, thin, slightly separated plates that have very large surface areas and fluid passages for heat transfer.

Although spiral and plate exchangers are promoted as being able to handle slurries, they employ fluid passages having physical dimensions that are typically not conducive to maintaining a good suspension of solids in the slurry. Spiral and plate exchangers do not have easily accessible passages and in some cases have no access at all, leading to high maintenance costs. Spiral and plate exchangers can be used in some slurry applications, but in fact they can be used only for relatively simple and dilute slurries in which the slurry particles stay easily suspended in the liquid.

Shell-and-tube exchangers are currently used in some slurry applications as well. A shell and tube exchanger consists of a series of tubes running through a shell and containing a medium to be either heated or cooled. The shell (or larger tube) contains a second flowing medium which either provides or absorbs the heat as required.

Currently it is possible to heat a slurry in the tube side of a shell-and-tube exchanger in which the shell contains a non-slurry (liquid or steam), but it is not possible to transfer heat from a slurry to a slurry, because the slurry cannot be run in the shell side, where large particles will settle out, causing fouling and eventually blockage.

In the 1990s, several plants that processed nickel ore were installed in Australia, all using high temperature autoclaves. Extensive research was performed for the design of these plants in order to select an effective heat exchanger. However, the best system which was found was a system in which steam was extracted by a slight vacuum from the slurry and then re-condensed in the shell of a shell-and-tube exchanger to heat the slurry passing in the opposite direction. Although these Nickel plants involved a combined capital investment of over US $1 Billion, the designers were not able to find a better way to transfer heat because there existed no design for a simple countercurrent exchanger which could transfer heat from one slurry to another. These complex heat exchange systems recycle only about 70 percent of the heat, representing a missed opportunity to significantly reduce operating costs. Autoclave plants with essentially the same expensive and inefficient design are still being constructed for recovery of metals such as nickel and gold.

Graphite block heat exchangers are also known in the art. In these exchangers graphite blocks are drilled with several closely spaced parallel holes for carrying the solution to be heated (or cooled), and other holes are drilled at right angles to them to carry the heating (or cooling) fluid. Such exchangers are widely used for heating and cooling acids. However they are limited in their usefulness for several reasons: graphite is soft and cannot be used for abrasive slurries; graphite can be oxidized and so is not chemically stable for some applications; graphite is brittle and has low strength, so the pressure at which these exchangers can operate is limited (high pressure causes cracks to form and propagate from tube to tube). Also, because of the brittleness of the graphite it is difficult to establish a tube header on the ends to provide a simple parallel tube arrangement having a straight flow path. To avoid this problem, graphite exchangers are designed with a cross-flow tube arrangement but this is not nearly as effective as a parallel flow arrangement.

Similar exchangers using other materials substituted for graphite have been encountered. An example of such an exchanger is disclosed in U.S. Pat. No. 1,799,626, disclosing tubes cast in a metal block. The tubing would not be effective in accomplishing countercurrent heating/cooling. Similarly, as shown in U.S. Pat. No. 4,711,298, ceramic block exchangers (similar to the graphite block exchangers) are known, but ceramic material also has the brittle qualities of graphite so the tubing arrangements are not simple enough for slurries. The inability of the existing technology to serve the needs of industries such as the mining industry is confirmed by the fact that a need exists, but there are no simple heat exchangers to serve that need.

Recently, a solid matrix tube-to-tube heat exchanger has come into use in the mineral ore processing industry. Such a heat exchanger is disclosed in U.S. Pat. No. 8,051,902, assigned to the same assignee of the present invention. While the heat exchanger disclosed in U.S. Pat. No. 8,051,902 filled a long-felt need in the mineral ore processing industry and other industries, there remains room for improvement. Specifically, the tube terminations specified in U.S. Pat. No. 8,051,902 are complex and expensive, resulting in an unnecessary impediment to installations where multiple modules needed to be connected together.

BRIEF DESCRIPTION

According to one aspect of the present invention, a solid matrix tube heat exchanger includes an assembly of solid matrix modules each formed from a thermally conductive material and having opposed first and second planar faces, each solid matrix module including a plurality of spaced-apart tubes embedded within the matrix, arranged in an identical pattern and extending between the first and second faces in an axial direction, the solid matrix modules positioned such that corresponding ones of the tubes in all of the solid matrix modules are axially aligned with each other, the corresponding ones of the tubes in adjacent ones of the solid matrix modules coupled to one another by nipples extending past the end of each tube, the nipples mechanically bonded to inner walls of the corresponding ones of the tubes.

According to one aspect of the present invention, the nipples are mechanically bonded to the inner walls of the corresponding ones of the tubes by expanding the nipples to the inner walls of the corresponding ones of the tubes at positions along lengths of the tubes that lie within the solid matrix modules.

According to one aspect of the present invention, the nipples are mechanically bonded to the inner walls of the corresponding ones of the tubes by an adhesive.

According to one aspect of the present invention, adjacent solid matrix modules are spaced apart from one another and at least one sensor is affixed to at least one of the tubes between adjacent solid matrix modules.

According to one aspect of the present invention, adjacent solid matrix modules are spaced apart from one another and at least one sampling tube is in fluid communication with at least one of the tubes between adjacent solid matrix modules.

According to one aspect of the present invention, the solid matrix modules are formed from aluminum.

According to one aspect of the present invention, the solid matrix modules have cross sections that are one of rectangular and circular.

According to one aspect of the present invention, an outer surface of each nipple is coated with one of a metal or an organic substance which enhances the bond between the nipple and the corresponding ones of the tubes.

According to one aspect of the present invention, one of ridges or grooves is provided on an outer surface of each nipple at the locations along their lengths that are to be expanded into the tubes.

According to one aspect of the present invention, the one of the ridges or grooves are axially oriented.

According to one aspect of the present invention, the one of the ridges or grooves are radially oriented.

According to one aspect of the present invention, the solid matrix tube heat exchanger of claim 1 further includes a first inlet manifold and a first outlet manifold disposed at a first end of the assembly, a second inlet manifold and a second outlet manifold disposed at a second end of the assembly, and a first group of tubes have first ends terminating in the first inlet manifold and a second end terminating in the second outlet manifold and a second group of tubes have first ends terminating in the second inlet manifold and a second end terminating in the first outlet manifold.

According to one aspect of the present invention, the solid matrix tube heat exchanger further includes a first plurality of inlet tubes and a first plurality of outlet tubes disposed at a solid matrix module at a first end of the assembly, a second plurality of inlet tubes and a second plurality of outlet tubes disposed at a solid matrix module at a second end of the assembly, and a first group of tubes in the solid matrix module at the first end of the assembly have first ends terminating in one of the first plurality of inlet tubes and a second group of tubes in the solid matrix module at the first end of the assembly have first ends terminating in one of the first plurality of outlet tubes, and a first group of tubes in the solid matrix module at the second end of the assembly have first ends terminating in one of the second plurality of inlet tubes and a second group of tubes in the solid matrix module at the second end of the assembly have first ends terminating in one of the second plurality of outlet tubes.

According to one aspect of the present invention, the first plurality of inlet tubes further comprise a plurality of nipples, each nipple aligned with the axis of one of the tubes of the first group of tubes in the solid matrix module at the first end of the assembly, the first plurality of output tubes further comprise a plurality of nipples, each nipple aligned with the axis of one of the tubes of the second group of tubes in the solid matrix module at the first end of the assembly, the second plurality of inlet tubes further comprise a plurality of nipples, each nipple aligned with the axis of one of the tubes of the first group of tubes in the solid matrix module at the second end of the assembly, and the second plurality of outlet tubes further comprise a plurality of nipples, each nipple aligned with the axis of one of the tubes of the second group of tubes in the solid matrix module at the second end of the assembly.

According to one aspect of the present invention, each of the first and second plurality of inlet tubes and outlet tubes include access ports, each access port aligned with an axis of one of its nipples.

According to one aspect of the present invention, all of the solid matrix modules have an equal length in a direction axially aligned with the tubes.

According to one aspect of the present invention, the solid matrix modules have at least two different lengths in a direction axially aligned with the tubes.

According to one aspect of the present invention, the tubes have a diameter from about 0.25 inch to about 6 inches.

According to one aspect of the present invention, the solid matrix modules have a width or diameter from about 3 inches to about 120 inches.

According to one aspect of the present invention, the solid matrix modules have a length from about 2 inches to about 600 inches in a direction along an axis of the tubes.

According to one aspect of the present invention, the number of tubes is from 2 to several hundred.

According to one aspect of the present invention, the solid matrix tube heat exchanger further includes an outer shell surrounding the solid matrix modules.

According to one aspect of the present invention, at least one gap between solid matrix modules is filled with a solid substance chosen to enhance the ability of the nipples to withstand pressure which may be applied to the assembly.

According to one aspect of the present invention, a method for manufacturing a solid matrix tube heat exchanger assembly includes providing a plurality of solid matrix modules formed from a thermally conductive material and having opposed first and second planar faces, each solid matrix module including a plurality of spaced-apart tubes arranged in an identical pattern and extending between the first and second faces in an axial direction, positioning the solid matrix modules such that adjacent solid matrix modules are spaced apart from one another by either a first distance or a second distance longer than the first distance and such that ends of corresponding ones of the tubes in all of the solid matrix modules are axially aligned with each other, inserting a nipple into the corresponding ones of the tubes in adjacent ones of the solid matrix modules coupled to one another by a nipple extending past the end of each tube, and expanding each nipple into fluid tight contact with inner walls of the corresponding ones of the tubes at locations along their lengths that lie within the solid matrix modules.

According to one aspect of the present invention, a method of manufacturing a solid matrix tube heat exchanger includes providing a block of solid matrix material, boring a series of close spaced parallel passages through the block, providing tubes of material from among those materials which can withstand chemical reactions which may take place from fluids flowing through the tubes, which have high heat transfer coefficients, which can withstand the high temperatures which they are expected to experience, and which are suitable hard so that they withstand the abrasion from the fluids which might flow through them, and inserting tubes into the block and expanding them in place, gluing them in place, or otherwise securing them in a manner that maximizes heat transfer from the tubes to the matrix.

According to one aspect of the present invention, providing the tubes further includes coating the tubes with a metal or other substance that at least one of enhances their ability to transfer heat or makes it easy to de-bond and remove the tubes for replacement.

A solid matrix tube heat exchanger includes an assembly of solid matrix modules sections, each module formed from a thermally conductive material and having opposed first and second planar faces, and each module including a plurality of spaced-apart tubes embedded in the thermally conductive material and arranged in an identical pattern and extending between the first and second faces in an axial direction, the modules sections positioned such that ends of corresponding ones of the tubes in all of the solid matrix modules sections are axially aligned with each other. The corresponding ones of the tubes in adjacent ones of the modules sections in the heat exchanger assembly are coupled to one another by nipples extending past the end of each tube, the nipples mechanically bonded with inner walls of the corresponding ones of the tubes at positions along their lengths that lie within the solid matrix modules assembly.

DESCRIPTION

Figure 1A:
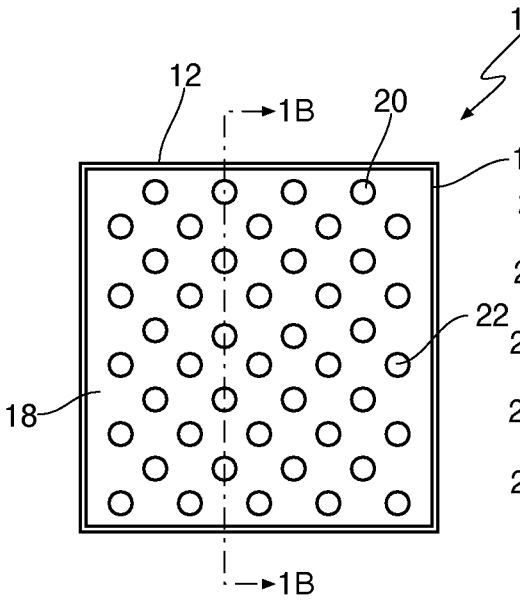
FIG. 1A is an end view of an illustrative individual heat exchange module of a heat exchanger according to a typical instance of the present invention.
Figure 1B:
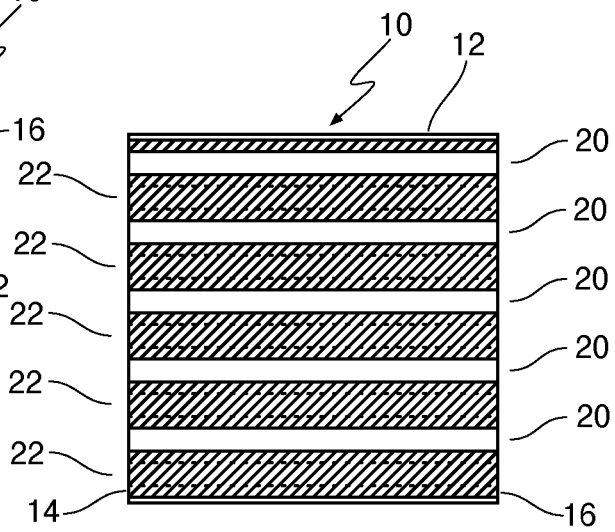
FIG. 1B is a cross-sectional view of the illustrative individual heat exchange module of a heat exchanger of FIG. 1A taken through line 1B-1B.

Persons of ordinary skill in the art will realize that the following description of the present invention is illustrative only and not in any way limiting. Other instances of the invention will readily suggest themselves to such skilled persons.

Referring now to FIGS. 1A, 1B, 1C, and 1D, end and cross-sectional views show an illustrative individual heat exchange solid matrix module 10 according to non-limiting typical instances of the present invention. The solid matrix module 10 may include an outer shell 12 having a first end 14 and a second end 16 surrounding a block of matrix material 18. The matrix material 18 in the solid matrix modules 10 (see FIG. 2A) may be formed, for example, from any of a variety of heat-conductive materials which can be precision drilled or can be cast around the tubes, such as metals, ceramics, composites, glasses, plastics, graphite, etc. The dimensions of the modules 10 are not critical. As non-limiting examples, module width or diameter may be from about 3 inches to about 120 inches and module length may be from about 2 inches to about 600 inches.

Figure 2A:
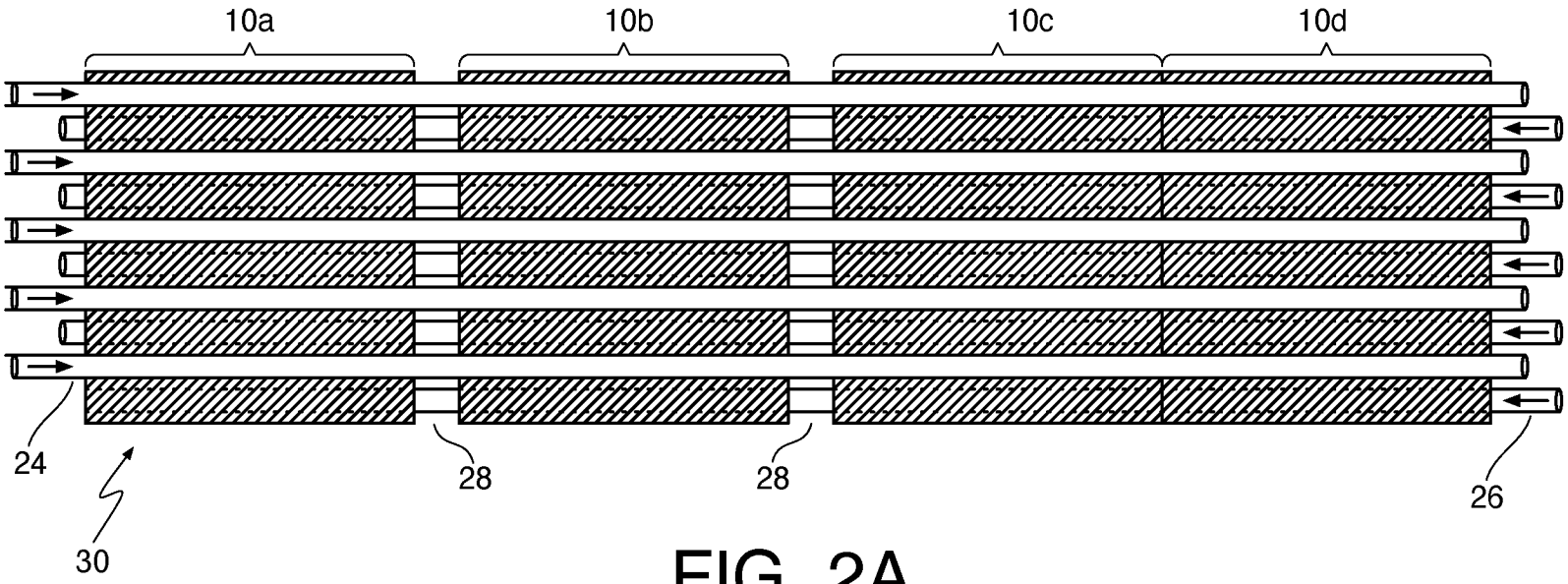
FIG. 2A is a cross-sectional diagram of an illustrative heat exchanger assembly according to the principles of the present invention.

The solid matrix modules 10 include a first set of passages 20 and a second set of passages 22 into which tubes are affixed (shown at reference numerals 24 and 26 respectively in FIG. 2A). The tubes 24 and 26 can be formed from a variety of metals, selected for their ability to be not reactive to the fluids being transported, their ability to withstand the conditions by which they are inserted into and/or bonded with the matrix, and their ability to resist the attachment of chemical scale to the tube surfaces.

According to one instance of the present invention, the tubes 24 and 26 which are affixed in the passages 20 and 22 are coated with a material which provides excellent heat coupling and heat transfer, but which provides an interface between the tube and the matrix material 18 which may be utilized to extract (and replace) individual tubes 24 or 26. Examples of such materials are (but not limited to) the metal lead or metal alloys which melt at temperatures lower than the melting point of both the tubes 24 and 26 or the matrix material 18, and brittle non-metals such as high heat transfer epoxies that will easily de-bond from the matrix material 18 when the tube is deformed by a tube cutting/deforming blade.

According to one aspect of the present invention, the unique properties of the solid matrix modules 10, especially the characteristic that the tubes 24 and 26 are surrounded by the matrix material 18 which allows almost unlimited pressures to be attained in the tubes subject to the compressive strength of the matrix material 18, and the ability of the tubes to continuously transfer heat to the fluids in the adjacent tubes, allow an assembly of solid matrix modules 10 to function as a continuous high pressure pipe reactor, even to the extent that the high pressures and temperatures attainable in the heat exchanger assembly may allow it to completely replace larger reaction vessels such as autoclaves.

Figure 1C:
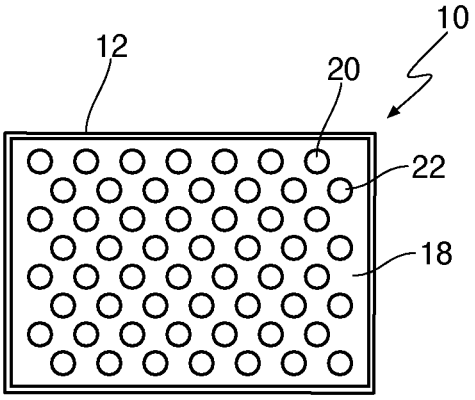
FIG. 1C is an end view of another illustrative individual heat exchange module of a heat exchanger of FIGS. 1A and 1B.
Figure 1D:
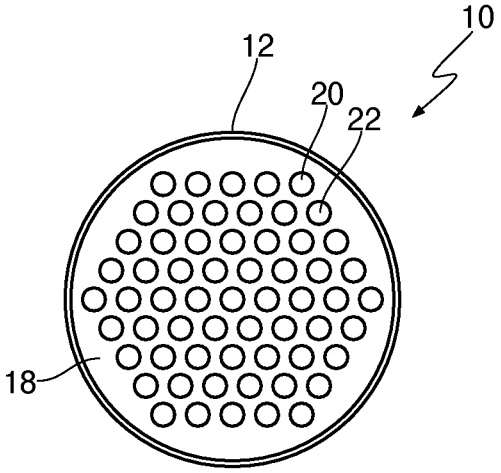
FIG. 1D is an end view of another illustrative individual heat exchange module of a heat exchanger.
Figure 2B:
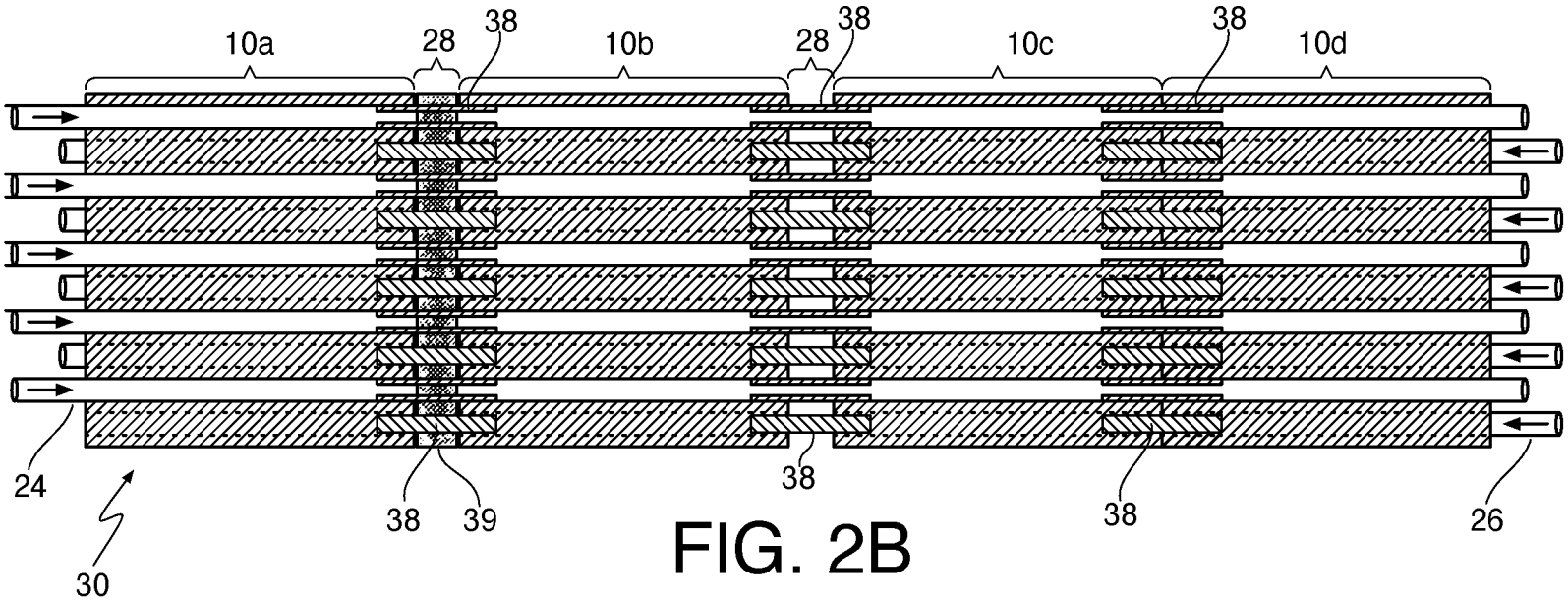
FIGS. 2B, 2C and 2D are cross-sectional diagrams of an illustrative heat exchanger body showing placement of sensors and ports according to the principles of the present invention.
Figure 2C:
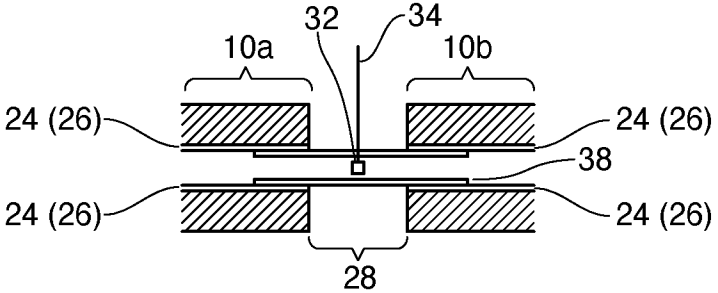

Referring now to FIGS. 2A, 2B, and 2C, in the heat exchanger assembly 30, each module 10 has an identical pattern of passages formed through it and the modules 10 are aligned such that the passages in all of the modules sections 10 are in alignment with one another. The passages 20 and 22 (shown in FIGS. 1A, 1B, 1C, and 1D) may be formed by accurately boring holes in the matrix, or by casting the matrix around the tubes.

In the particular instance of the invention illustrated in FIG. 1C, the module 10 is shown as being rectangular in cross section. In the particular instance illustrated in FIG. 1D, the module 10 is shown as being circular in cross section. Persons of ordinary skill in the art will appreciate that other cross-sectional shapes, such as but not limited to oval shapes and even irregular cross sectional shapes, are contemplated to be within the scope of the present invention.

Referring now to FIG. 2A, a cross-sectional view shows a solid matrix material tube-to-tube heat exchanger assembly 30 formed from a plurality of modules 10*a*, 10*b*, 10*c*, and 10*d* placed so that the passages in each module are in alignment with one another. A set of first tubes 24 and a set of second tubes 26 are alternately disposed in the passages, either by insertion (if the passages are bored) or by casting the matrix material around the tubes.

FIG. 2A shows the heat exchanger assembly 30 with the tubes 24 and 26 oriented horizontally. Persons of ordinary skill in the art will appreciate that the heat exchanger module 30 may be arranged so that the first and second tubes 24 and 26 are oriented horizontally or vertically. The cross section shown in FIG. 2A is taken through the center of one column of tubes 24. Four illustrative modules 10*a* through 10*d* are shown in FIG. 2A, but persons of ordinary skill in the art will appreciate that an arbitrary number of modules sections 10 may be used to make heat exchangers assemblies of varying sizes and capacities. Lengths for assembly 30 of about four feet or less to over about 600 feet or more, as well as other lengths are within the scope of the present invention.

The plurality of first and second tubes 24 and 26 run through the solid matrix modules 10*a* through 10*d* of heat exchanger assembly 30. The first and second tubes 24 and 26 extend out of ends of solid matrix modules 10*a* and 10*d* of heat exchanger assembly 30. Tube diameter is not critical. Non-limiting examples of tube diameter range from about 0.25 inch to about 6 inches. Although small-diameter tubes are very effective at transferring heat, some slurries (because they possess higher viscosities or contain larger particulate sizes) need to be processed through larger diameter tubes. Also larger diameter tubes may be selected for use in process plants with very high liquid or slurry flowrates because the capital and maintenance costs of the heat exchanger increase as the tubing diameter decreases.

In one instance of the invention, in which the tubes are mated with the matrix material by forming passages in the matrix material, then inserting the tubes into the passages of the matrix material, the diameter of the passages should be just large enough and the outside diameter of the first and second tubes 24 and 26 should be just large enough to allow the tubes to be slip fit inserted without difficulty due to friction. The first and second tubes 24 and 26 are then radially expanded to provide an interference fit within the respective passages to maximize heat exchange with the module. In another instance of the invention, the solid matrix material is cast around the first and second tubes 24 and 26. In either case of inserting the tubes 24 and 26 into passages or casting the solid matrix material 18 around the first and second tubes, ones of the first and second tubes 24 and 26 are alternated in a close-spaced geometric pattern in such an arrangement and spacing in order to ensure the effective transfer of heat from the fluid in one set of tubes to the fluid in the adjacent set.

According to various instances of the present invention, the plurality of tubes 24 and 26 may be arranged in a parallel tube configuration similar to the bundle used in a shell-and-tube exchanger. Tube dimensions and geometries similar to those employed in shell-and-tube exchangers can be used. Tube sizing and spacing is selected to maximize heat transfer between the tubes and the heat-conductive medium of the solid matrix modules 10, depending on the type of slurry or process fluid and the cost tradeoffs in building and servicing the exchanger. Similarly, the number of tubes can vary from two tubes to a very large number (similar to some shell and tube exchangers that have more than 1,000 tubes), depending on the total flowrate of the liquid or slurry to be processed.

As may be seen in FIG. 2A, at least some of the solid matrix modules 10 are positioned such that inter-module spaces 28 are maintained between them. In the particular instance shown in FIG. 2A, inter-module spaces 28 are maintained between adjacent modules 10*a* and 10*b*, and between adjacent modules 10*b* and 10*c*. Solid matrix modules 10*c* and 10*d* are shown in close proximity to one another. Distances of zero to four inches may be typical. Persons of ordinary skill in the art will appreciate that, in a multi-module assembly according to the present invention such as that shown in FIG. 2A, the number of adjacent modules spaced apart by inter-module spaces 28 (e.g., solid matrix modules 10*a* and 10*b*) and the number of adjacent modules (e.g., modules 10*c* and 10*d*) placed in contact with one another, is arbitrary and will depend on the particular needs encountered in the design of the assembly.

Referring now to FIG. 2C, another aspect of the present invention is illustrated. In FIG. 2C, a cross-sectional diagram of the detail of inter-module space 28 between solid matrix modules 10*a* and 10*b* shows a plurality of sensors (one of which is designated by reference numeral 32) affixed to nipple 38 that joins tubes 24 and 26. Persons of ordinary skill in the art will comprehend that FIG. 2C is merely illustrative, and sensors do not need to be affixed to all of the nipples 38 that join tubes 24 and 26. Sense cables (one of which is designated by reference numeral 34) communicate the outputs of the sensors 32 to equipment for reading their states.

Figure 2D:
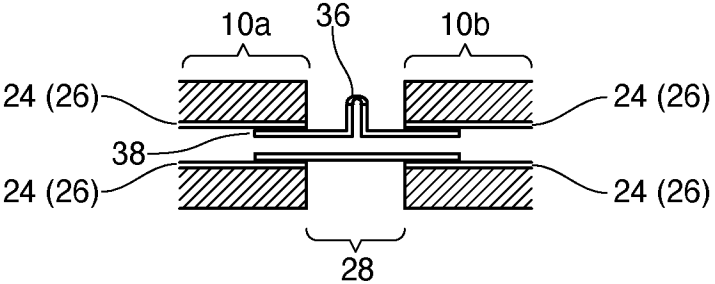

FIG. 2D is a cross-sectional diagram of the detail of inter-module space 28 between solid matrix modules 10*b* and 10*c* and shows a plurality of ports (one of which is designated by reference numeral 36 formed in nipple 38 that joins a pair of aligned tubes 24). The ports 36 may be used to sample the slurry flowing through the tubes 24 and 26 for chemical or other analysis, or may be used to introduce reactants in instances where the heat exchanger assembly is being used as a pipe reactor. As with sensors 32, persons of ordinary skill in the art will comprehend that FIG. 2D is merely illustrative, and ports 36 do not need to be provided for all of them nipples connecting tubes 24 and 26. Also, for constructability purposes, the ports 36 will immediately progress to elbows or other pipe features which all the pipes connected to the ports to clear the adjacent nipples. Similarly, such skilled persons will appreciate that a mixture of both sensors 32 and ports 36 may be provided for nipples connecting some or all of tubes 24 and 26 in any or all of inter-module spaces 28.

According to another aspect of the invention illustrated in FIGS. 2B, 2C and 2D, each of the solid matrix modules 10*a*, 10*b*, 10*c*, and 10*d* may have the tubes 24 and 26 affixed into them and ends of the tubes in adjacent solid matrix modules may be joined by coupling nipples 38, which are inserted into opposing ends of each of the tubes 24 and 26 in adjacent ones of the solid matrix modules 10*a*, 10*b*, 10*c*, and 10*d*. Each end of each one of the coupling nipples 38 where the nipple is inserted far enough into the tube so that the tube is supported on the outside of the tube by the matrix material 18, is then mechanically bonded to the inner wall of the tube to form a mechanically strong, robust, and leakproof connection. The solid matrix modules are positioned so that the tubes are aligned. One end of the nipple may be inserted into a tube in the first solid matrix module a distance of an inch up to six inches or more, and in one instance of the invention is then mechanically or hydraulically expanded over a zone of 0.1 inches to two inches or more, under very high pressure to form the required bond, which is only possible because the tubes in the zone of expansion are completely embedded in the solid matrix modules. The other end of the nipple is inserted into a corresponding tube in the second solid matrix module a distance of an inch up to six inches or more, then mechanically or hydraulically expanded over a zone of 0.1 inches to two inches or more, under very high pressure to form the required bond.

In one instance of the present invention, as illustrated in FIG. 2B, after assembly of one solid matrix module to the other, one or more of the inter-module spaces 28 between the solid matrix modules is filled with a solid substance such as a low-melting-temperature poured metal, or a high-compression-strength settable compound such as the type used by machinists to affix crusher liners into crushers or shaft sleeves onto shafts, or a high strength cementitious grout (shown as a stippled region 39 in FIG. 2B in the inter-module space between solid matrix modules 10*a* and 10*b*) which encases the nipples to further enhance their ability to withstand the very high pressure which may be applied to the assembly during its operation.

In one instance of the present invention, when there are several (up to several hundred) tubes in a first heat exchanger solid matrix module to be coupled with corresponding tubes in a second heat exchanger solid matrix module, all of the nipples 38 are bonded into the tubes in the first heat exchanger solid matrix module and then the exchangers are repositioned to cause all of the free ends of the nipples 38 to be inserted into the corresponding tubes in the second heat exchanger solid matrix module, and then each of the nipples 38 is bonded to each of the second tubes.

As will be appreciated by persons of ordinary skill in the art, there now exists on the commercial market a tool for bonding tubes into the tubesheet usually provided at the ends of a shell and tube heat exchanger. This tool consists of a conical mandrel with rollers which expand the tubes into the tubesheet which is typically located within an inch or so of the accessible end of the exchanger. In accordance with the present invention, a similar tool can be used which is fabricated so that the mandrel is situated at the end of an extension rod which may be inserted into the tubes to the appropriate position where nipple expansion will take place. This extension rod can be fabricated so that the mandrel can be positioned accurately if the area of the nipple 38 to be expanded is a few inches into the exchanger solid matrix module, or if the area of the nipple 38 to be expanded is up to 40 or more feet into the exchanger solid matrix module, so as to allow the expansion of the nipple inserted into the second tube at the end of the second matrix module, using a tool inserted from the far (free and open) end of the second matrix module. This process forms a mechanically strong, robust, and leakproof connection between the nipple 38 and the tubes 24 or 26 to which it is bonded.

Alternately, the nipples 38 may be expanded into the tubes 24 or 26 using the well-known very high hydraulic pressure technique employing equipment which is commercially available for high-pressure expansion of tubes.

In another instance of the present invention, the nipples 38 may be bonded to the tubes 24 or 26 using adhesives such as bonding pastes, glues or epoxies chosen to be compatible with the tube material and the nipples. This may be especially appropriate if the tubes 24 or 26 are made from a non-metallic substance such as glass or ceramic, the choice of such adhesives is well within the level of persons of ordinary skill in the art knowing the composition of the tube material and the nipples.

In one instance of the present invention, the solid matrix module tube heat exchanger assembly consists of adjacent solid matrix modules which may be intentionally separated from each other by a selected inter-module space by the use of nipples which have an extended length (longer than are needed if the exchanger solid matrix modules are in contact or closely spaced with respect to each other). Exchanger solid matrix modules separated by such distances may include at least one sensor affixed to at least one of the nipples between adjacent module sections spaced apart by the selected space.

In one instance of the present invention, the solid matrix tube heat exchanger assembly further includes at least one sampling tube port or externally connected tube which may be used for sampling or for introduction of agents for modifying the chemical reactions taking place within the tube, fluidly communicating with at least one of the tube nipples between spaced apart adjacent solid matrix modules.

In one instance of the present invention, the solid matrix modules are formed from aluminum, and the embedded tubes are formed from stainless steel, but a variety of other materials are available which may be chosen to fit different design conditions.

In another instance of the present invention, the inter-module space 28 is at least wide enough to accommodate a cutting tool such as a band saw, so that an individual solid matrix module which needs servicing or replacing can be removed from the assembly of solid matrix modules. A replacement solid matrix module can then be assembled with inserted (but not bonded) nipples 38 in each end. Remote expander tools of the same type used for initial assembly may then be used to position and bond the nipples 38 to the inner walls of the tubes 24 or 26.

Referring now to FIGS. 3A, 3B, 3C and 3D, FIG. 3A is an isometric diagram which shows an arrangement of input header 40 and output header 42 at one end of a solid matrix module 10*d* which is positioned at one of the extreme ends of the heat exchanger assembly. An access cap (one of which is indicated at reference numeral 44) is axially aligned with each of tubes 24 and 26. The access caps are used to provide access to tubes 24 and 26 for a tube expander tool used to expand coupling nipples 38 at any location along the assembly, but in the immediate instance are used to expand the nipples which form a part of the header assembly 40 or 42, may be coupled to the input header assembly 40 and output header assembly 42 by threaded fittings.

Figure 3A:
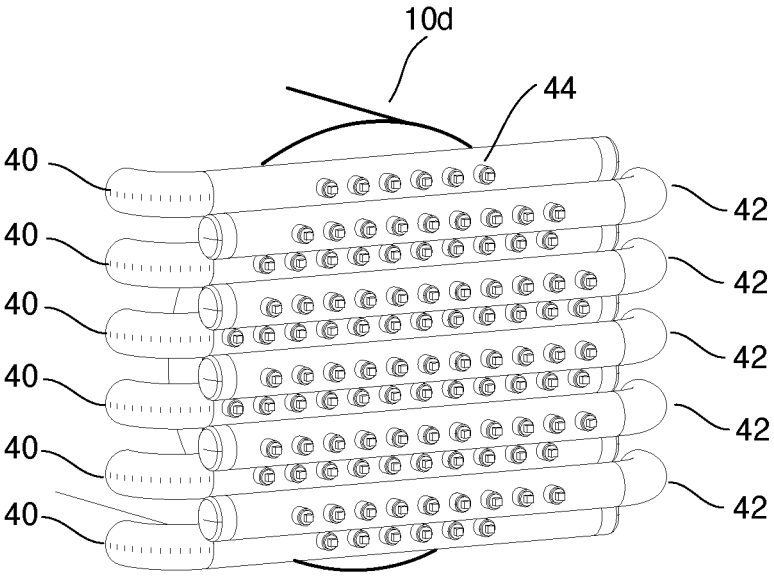
FIG. 3A is an isometric drawing showing an aspect of the invention in which input and outlet nipple/header assemblies are coupled to the ends of tubes at each end of the heat exchanger assembly of FIG. 2A.
Figure 3D:
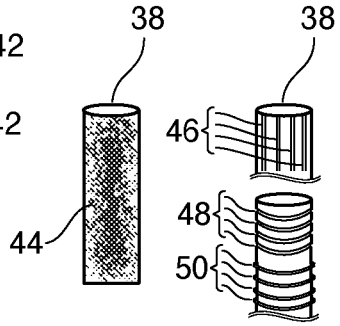
FIG. 3D is a diagram showing techniques applied to the nipples to increase the strength of the bond between the nipples and the tubes.
Figure 3B:
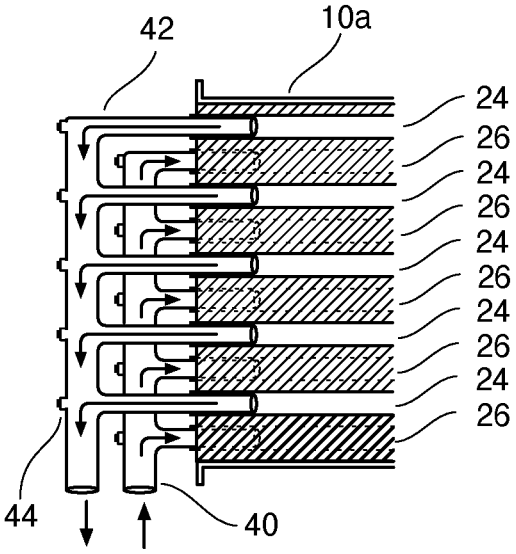
FIGS. 3B and 3C are cross-sectional diagrams showing examples of input and outlet nipples coupled to the ends of tubes at each end of the heat exchanger assembly of FIG. 2A.
Figure 3C:
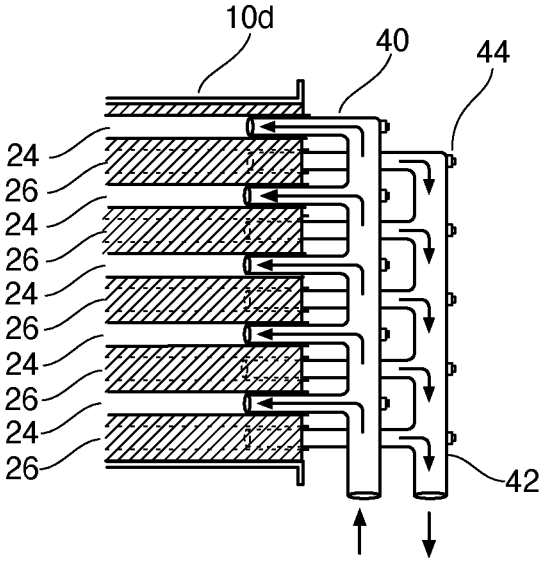

Referring now to FIGS. 3B and 3C, cross-sectional diagrams show ends of modules 10*a* and 10*d*, respectively, of the heat exchanger assembly 30 of FIG. 2A according to one illustrative instance of the invention that that uses counterflow heat exchanging. The instance illustrated in FIGS. 3A and 3C shows the inlet and outlet headers 40 and 42 fluidly coupled to the ends of tubes 24 and 26 at solid matrix modules (e.g., 10*a*, 10*d* in FIGS. 2A and 2D) at each end of the heat exchanger body 30 of FIG. 2A. FIGS. 3B and 3D shows the inlet and outlet headers 40 and 42 fluidly coupled to the ends of tubes 24 and 26 at each end of the heat exchanger assembly 30 of FIG. 2A and exiting from different directions.

In accordance with the present invention, techniques may be employed to enhance the bond and/or enhance the heat transfer efficiency between the tube 24 or 26 and the nipple 38. Referring now to FIG. 3D, two illustrative nipples 38 are shown. The outer surface of the leftmost nipple 38 is coated on the outside, at least over the area where the nipples 38 will be expanded into the tubes 24 or 26, with a metal or organic substance 44 which enhances the bond between the outer surface of the nipple 38 and the inner wall of the one of the tubes 24 or 26 into which it is expanded. Examples of such metals or organic substances 44 include, but are not limited to, softer metals which flow to form a tight heat transfer bond, metals which may enhance the compatibility of the nipple material with the tube material by, for example, alloying with both materials, chemical compounds such as epoxies which become rigid during the bonding process to enhance mechanical stability, and chemical compounds such as heat transfer compounds which may remain in a semi-liquid state but which enhance the heat transfer ability of the bond. The rightmost nipple 38 is shown having been modified to include axial grooves 48 or ridges 50 (top portion of figure) or radial grooves 48 or ridges 50 (bottom portion of figure) formed at least over the area where the nipples 38 will be expanded into the tubes 24 or 26 to enhance the mechanical strength of the bond between the tube 24 or 26 and the nipple 38.

Figure 4A:
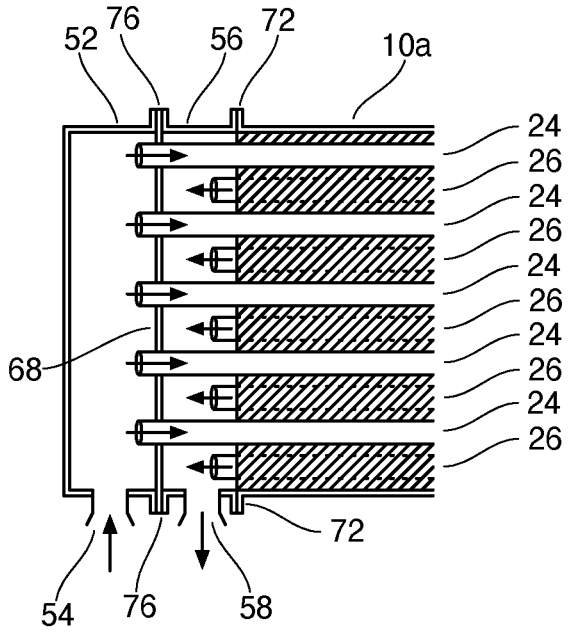
FIGS. 4A and 4B are diagrams showing one aspect of the invention in which different orientations of manifolds are coupled to the ends of tubes at each end of the heat exchanger assembly of FIG. 2A.
Figure 4B:
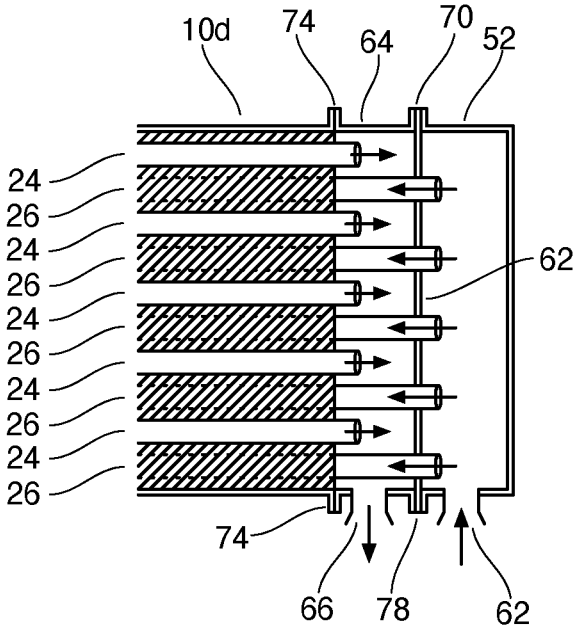

Referring now to FIGS. 4A and 4B, cross-sectional diagrams show ends of solid matrix modules 10*a* and 10*d*, respectively, of the heat exchanger body 30 of FIG. 2A according to another illustrative instance of the invention that uses counterflow heat exchanging. As shown in FIG. 4A, first ends of tubes 26 extending from the end of solid matrix module 10*a* are coupled through first inlet manifold 52 to a first inlet 54. Second ends of tubes 24 extending from the end of solid matrix module 10*a* are coupled through first outlet manifold 56 into a first outlet 58. Similarly, and as shown in FIG. 4B, first ends of tubes 26 extending from the end of solid matrix module 10*d* are coupled through second inlet manifold 60 from a second inlet 62. Second ends of tubes 24 extending from the end of solid matrix module 10*d* are coupled through second outlet manifold 64 to a second outlet 66. As is known in the art, inlets 54 and 62 and outlets 58 and 66 will be provided with appropriate fittings to couple them to respective slurry streams.

In one instance of the invention, inlet manifold 52 is separated from outlet manifold 56 by baffle 68. Inlet manifold 60 is separated from outlet manifold 64 by baffle 70. Baffles 68 and 70 prevent mixing of the two sets of solutions, but allow the fluids or slurries in each set of tubes to flow in a single pass from end to end of the exchanger. Each of the inlet and outlet manifolds 52, 56 60, and 64 is designed to collect all of the flow from one set of tubes (or to introduce such flow into the set of tubes). The tubing diameters and manifold are designed and arranged in such a manner as to allow uniform flow of slurries (such as mineral slurries in a water-based or corrosive solution) without settling out of solids, and preventing the mixing of the flows from the two different sets of tubes. In one illustrative instance of the invention, the manifolds 56 and 64 may be bolted to their respective solid matrix modules 10*a* and 10*d* at mating annular flanges 72 and 74 (bolts not shown). Similarly, manifolds 52 and 60 may be bolted (bolts not shown) or otherwise fastened to the baffles 68 and 70 and the manifolds 56 and 64 at mating annular flanges 76 and 78. This construction facilitates the disassembly of heat exchanger assembly 30 for repair or maintenance.

As described above, the ends of heat exchanger assembly 30 are configured in such a manner that solution or slurries (fluid) will maintain a simple and uniform flow path. The seals between the tubes and the baffles 68 and 70 may be made using compression fittings or O-ring seals such that the manifold assemblies and baffles can be easily removed for servicing. Persons of ordinary skill in the art will appreciate that the inlet and outlet functions of one of the sets of manifolds could be reversed in accordance with other instances of the present invention such that a concurrent flow arrangement instead of a counterflow arrangement is realized.

Persons of ordinary skill in the art will appreciate that the manifolds described above are only one example of a way that the ends of the first and second sets of tubes may be coupled to one another. As a non-limiting example, the ends of the tubes may be merged with one another using the tubing or piping connections shown in FIGS. 3A through 3C.

In a method according to the present invention, heat may be transferred in a tubular heat exchanger from the flowing contents of the first set of tubes 24 to the flowing contents of the second set of tubes 26 by arranging for the flow to occur as a single pass from one end of the exchanger assembly to the other, either co-current (flowing contents in both sets of tubes enter at the same end of the exchanger) or countercurrent in which a first solution or slurry enters a first end of the heat exchanger assembly 30 at the left-most end of module 10*a* and exits at a second end of the heat exchanger body 30 at the right-most end of module 10*d*, while a second solution or slurry enters the second end of the heat exchanger body 30 at the right-most end of module 10*d* and exits at the first end of the heat exchanger body 30 at the left-most end of module 10*a*.

In operation, the slurry to be heated or cooled is run in a first set of the tubes, and a similar slurry with a different heating profile is run in a second set of the tubes, each tube in the second set adjacent to at least one of the tubes in the first set of tubes. The present invention is particularly useful when the two slurries are run in opposite (countercurrent) directions, thus heating one slurry while cooling the other. In a typical system it is possible to heat a slurry in such a countercurrent configuration from room temperature to a very high temperature (e.g., 400° C.) against a returning heated slurry which is cooled from the high temperature to room temperature. The temperature approach of the two slurries can be as close as a few degrees C., so that even though the slurry at the high-temperature end may be at, for example, 200° C., only enough heat needs to be added to raise the slurry a few degrees C.

The spacing of tubes 24 and 26 is more important in the present invention than in a typical shell and tube exchanger, and is based on mathematical modeling of heat flow from tubes in one set to the alternating (intercalated) tubes in the second set. If the tubes are too far apart, then the heat leaving the tube and entering the heat transfer matrix can flow parallel to the tube axis and enter either the same tube or the adjacent tube at a non-perpendicular point. This results in "smearing" of the heat transfer effect. In the best geometry, heat flows directly out of one tube and into the adjacent tube using the shortest flowpath which is a straight line flowpath perpendicular to the tube axes. This requires close tube spacing, but if the tubes are too close, then construction of the exchanger is difficult and expensive. The best matrix is not necessarily made from the most heat-conductive material, but rather from a material that maximizes perpendicular heat flow within the tube spacing constraints. In practice for most materials and mediums, the center-to-center spacing of the tubes may be between about 0.125 inch larger than the tube diameter and about 0.750 inch larger than the tube diameter.

If the heat exchanger is designed in accordance with the present invention, most of the heat flows perpendicular to the tube axes. This results in the heat exchanger having a very large number, almost an infinite number, of theoretical heat exchange stages. With such a design it is possible to get a very close temperature approach from the liquid or slurry flowing in one set of tubes 24 to the liquid or slurry flowing in the other set of tubes 26. This is one of the distinguishing features of the present invention. In a shell and tube exchanger with fluid in the shell, the number of theoretical stages is dictated by the effectiveness of the flowpath in the shell and is usually a small number. As an extreme example, heat can be extracted as steam in the shell from a slurry in the tubes, but in this case there is only one theoretical stage of transfer regardless of the length of the exchanger, since the steam in the shell is all at the same temperature. The effect of a low number of theoretical stages is that the exchanger assembly must be much longer (or have multiple discrete units) in order to achieve the same temperature profile as a heat exchanger with a large number of theoretical stages. In shell and tube exchanger configurations processing slurries, the extracted heat must be sent to a second exchanger where the heat is then transferred to the other slurry. The present invention allows the efficient design of an exchanger for the extraction and simultaneous transfer of the heat when the flowing fluid is a slurry.

In one instance of the present invention, stainless steel tubes with an OD of ⅝ inches and an ID of ½ inches were placed in a pattern ⅞ inches on centers, and a solid aluminum matrix was cast around them. The thickness of the "shell" matrix surrounding the outer row of tubes was varied, and it was determined that a satisfactory thickness of the shell matrix surrounding the outer row of tubes is approximately half the tube diameter. This apparatus was employed to heat and cool slurry continuously such that the temperature of inlet and outlet slurry were within 10° C. of ambient conditions while the slurry at the highest temperature module was 220° C., with the introduction of heat at the hot end being only enough heat to raise the temperature 10° C. Although small-diameter tubes are very effective at transferring heat, much larger tubes need to be employed to process some slurries (because they possess much higher viscosities). Also for process plants that use very high liquid or slurry flowrates, larger tubes may be selected because the capital and maintenance costs of the exchanger both increase as the tubing diameter decreases.

Figure 5A:
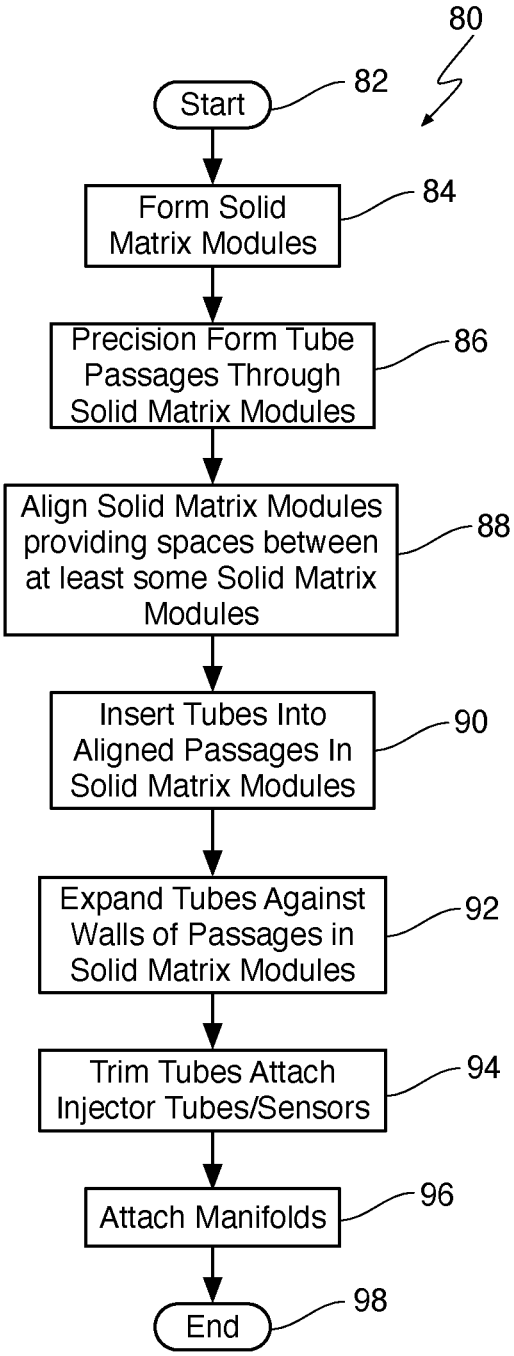
FIG. 5A is a diagram of a process for fabricating an illustrative heat exchanger according to an aspect of the present invention.

Referring now to FIG. 5A, a diagram shows an illustrative process 80 for fabricating an illustrative heat exchanger according to an aspect of the present invention. The process starts at reference numeral 82. At reference numeral 84 solid matrix modules are formed. At reference numeral 86, the solid matrix modules are drilled to form the tube passages. Persons of ordinary skill in the art will appreciate that other methods could be used to form the tube passages.

At reference numeral 88 the solid matrix modules are arranged in an assembly with the passages in adjacent modules aligned with one another. According to the present invention, at least some of the adjacent modules are spaced apart from one another. At reference numeral 90, the tubes are inserted into the passages of the aligned modules with ends extending out of both ends of the assembly of modules. At reference numeral 92, the tubes are radially expanded against the walls of the passages in the solid matrix modules to form a friction fit in the aligned passages.

At reference numeral 94 the exposed ends of the tubes are trimmed to lengths determined by the types of connections that will be provided. At reference numeral 96 the manifolds or other connections/fittings, are attached to the ends of the tubes and/or ends of the module assembly. The process ends at reference numeral 98.

Figure 5B:
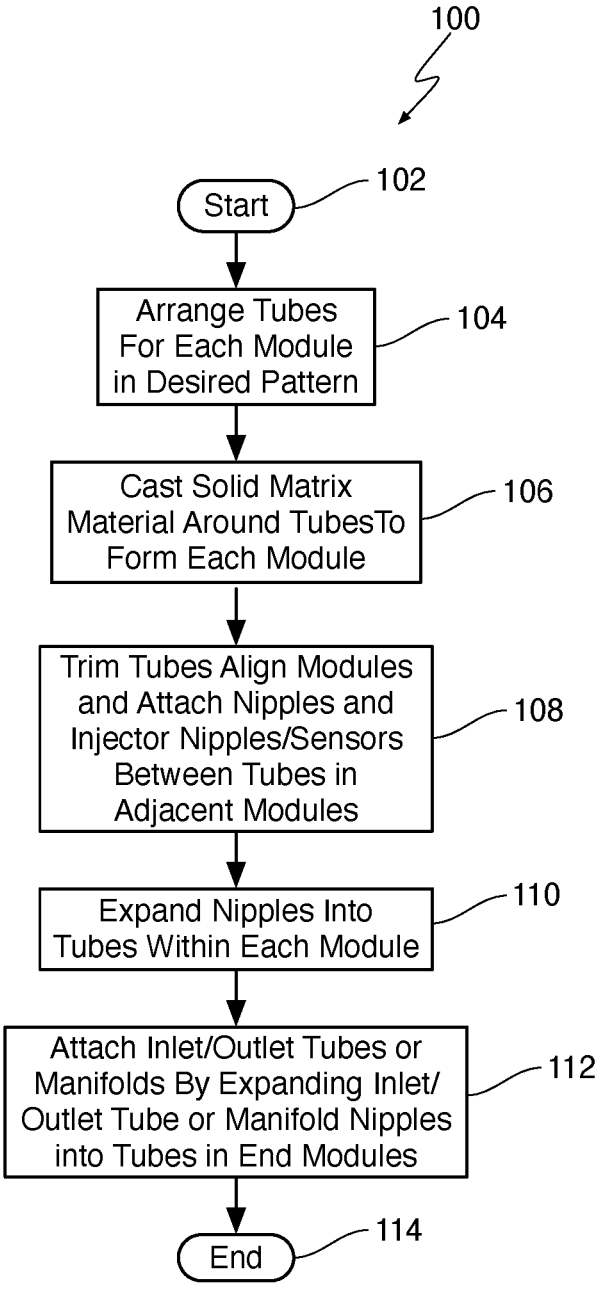
FIG. 5B is a diagram of a process for fabricating an illustrative heat exchanger according to another aspect of the present invention.

Referring now to FIG. 5B, a diagram shows an illustrative process 100 for fabricating an illustrative heat exchanger according to an aspect of the present invention. The process starts at reference numeral 102. At reference numeral 104 the tubes for each module are arranged in a desired pattern. At reference numeral 106, the solid matrix material for the modules are each cast around the tubes.

At reference numeral 108 the exposed ends of the tubes are trimmed to lengths determined by the types of connections (e.g., sensors, sample tubes) that will be provided and the nipples and sensors are attached between tubes in adjacent ones of the modules. At reference numeral 110 the nipples are expanded into the tubes to form tight seals to the tubes. At reference numeral 112, the manifolds are attached by expanding the manifold nipples into the tubes in each end module. The process ends at reference numeral 114.

Figure 6:
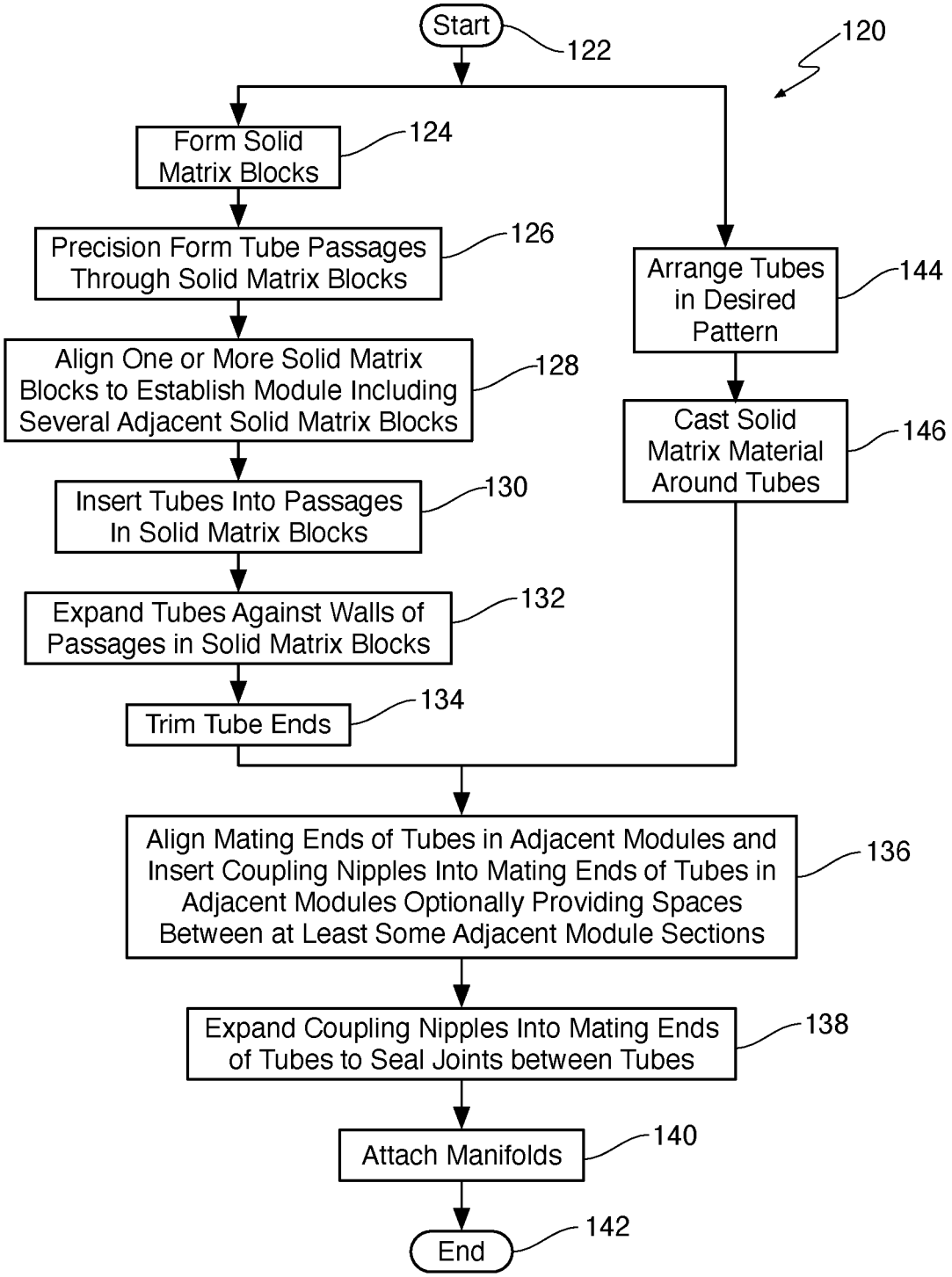
FIG. 6 is a diagram of a process for fabricating another illustrative heat exchanger according to the principles of the present invention.

Referring now to FIG. 6, a diagram shows an illustrative process 120 showing alternate ways for fabricating another illustrative heat exchanger according to the principles of the present invention. The method begins at reference numeral 122.

According to a first way for fabricating another illustrative heat exchanger in accordance with the principles of the present invention, at reference numeral 124 solid matrix blocks for the modules are formed. At reference numeral 126 precision tube passages are formed through the solid matrix blocks.

At reference numeral 128 one or more solid matrix blocks are aligned to establish a module including several solid matrix blocks. At reference numeral 130 tubes are inserted into the aligned passages of the solid matrix blocks.

At reference numeral 132, the tubes are expanded against the walls of the aligned solid matrix blocks. At reference numeral 134 the tube ends extending from the end blocks are trimmed.

At reference numeral 136, the mating ends of tubes in adjacent modules are aligned and coupling nipples are inserted into mating ends of tubes in adjacent modules, optionally providing spaces between at least some adjacent module sections. At reference numeral 138, the coupling nipples are expanded into the mating ends of tubes to seal joints between the tubes to form the assembly.

At reference numeral 140, the manifolds are attached at the ends of the assembly, preferably using the nipple expansion process previously described. The method ends at reference numeral 142.

According to a second way for fabricating another illustrative heat exchanger in accordance with the principles of the present invention, instead of proceeding from the start to reference numeral 124, at reference numeral 144, to form each module the tubes are arranged in a desired pattern. At reference numeral 146 the solid matrix material is cast around the tubes to form each module.

The method then proceeds to reference numerals 136, 138, and 140 as previously described, before ending at reference numeral 142.

The present invention satisfies a long felt and unsatisfied need for equipment that can effectively and efficiently transfer heat from one mineral ore slurry to another, and can be easily and economically assembled, maintained, and remanufactured if necessary. The present invention thus represents a major advance over existing prior-art heat exchangers that have not met this need.

While the present invention is disclosed in the context of heat exchange in mineral slurries in the mining industry, persons of ordinary skill in the art will recognize that it has much broader uses than mineral slurries, such as in various processes employed in the pharmaceutical, chemical, and other industries that currently use other types of heat exchangers.

A simple configuration in accordance with the present invention in which all fluids moving in either direction move through round, straight, non-fouling tubes which are easily accessible, and easily cleaned solves the problems of the prior art. The present invention provides a highly efficient, hitherto unavailable modular heat exchanger that significantly reduces maintenance and operating costs.

While instances and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A method for manufacturing a solid matrix tube heat exchanger assembly comprising:

providing a plurality of solid matrix modules formed from a thermally conductive material and having opposed first and second planar faces, each solid matrix module including a plurality of spaced-apart tubes arranged in an identical pattern and extending between the first and second faces in an axial direction;

positioning the solid matrix modules such that adjacent solid matrix modules are spaced apart from one another such that ends of corresponding ones of the tubes in all of the solid matrix modules are axially aligned with each other; and inserting a nipple into the corresponding ones of the tubes in adjacent ones of the solid matrix modules such that the nipple is inserted a distance sufficient for creating a bond into each of the corresponding ones of the tubes;

expanding each nipple into fluid tight contact with inner walls of the corresponding ones of the tubes at locations along their lengths that lie within the solid matrix modules.

2. The method of claim 1 wherein providing the tubes further includes coating the tubes with a metal or other substance that at least one of enhances their ability to transfer heat or makes it easy to de-bond and remove the tubes for replacement.

3. The method of claim 1 wherein positioning the solid matrix modules such that adjacent solid matrix modules are spaced apart from one another comprises positioning the solid matrix modules such that adjacent solid matrix modules are spaced apart from one another by either a first distance or a second distance longer than the first distance.

* * * * *